US007706705B2

(12) United States Patent
Tomita et al.

(10) Patent No.: US 7,706,705 B2
(45) Date of Patent: Apr. 27, 2010

(54) IMAGE FORMING APPARATUS AND CORRECTION METHOD OF IMAGE FORMING CONDITION

(75) Inventors: Norio Tomita, Nara (JP); Yoshikazu Harada, Nara (JP); Tetsushi Ito, Nara (JP); Showtaro Okamoto, Nara (JP); Tetsuya Yamaguchi, Nara (JP); Yoshiteru Kikuchi, Yamatokoriyama (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 137 days.

(21) Appl. No.: 11/944,896

(22) Filed: Nov. 26, 2007

(65) Prior Publication Data

US 2008/0131150 A1 Jun. 5, 2008

(30) Foreign Application Priority Data

Nov. 30, 2006 (JP) ..... 2006-323971

(51) Int. Cl.
*G03G 15/00* (2006.01)
*G03G 15/01* (2006.01)

(52) U.S. Cl. ..... 399/49; 399/72; 399/301

(58) Field of Classification Search ..... 399/49, 399/72, 299, 301
See application file for complete search history.

(56) References Cited

U.S. PATENT DOCUMENTS 5,760,795 A * 6/1998 Beck ..... 347/3
6,603,495 B2 * 8/2003 Hayakawa ..... 347/116
2005/0207767 A1 * 9/2005 Imayoshi et al. ..... 399/45

FOREIGN PATENT DOCUMENTS

| | | | |
|---|---|---|---|
| JP | 7-168413 | A | 7/1995 |
| JP | 2002-156820 | A | 5/2002 |
| JP | 2005-202110 | A | 7/2005 |
| JP | 2005-292760 | A | 10/2005 |
| JP | 2006-208724 | A | 8/2006 |

OTHER PUBLICATIONS

Machine translation of Japanese publication JP 2005-202110, publication date Jul. 28, 2005.*

* cited by examiner

*Primary Examiner*—David M Gray
*Assistant Examiner*—Rodney Bonnette
(74) *Attorney, Agent, or Firm*—Birch, Stewart, Kolasch & Birch, LLP

(57) ABSTRACT

An image forming apparatus including: image forming sections, each image forming section forming an image of a color component among plural color components under a predetermined condition, and forming a pattern of each color component for adjusting the condition; a detecting section that reads the formed patterns so as to perform a temporary detection and a main detection of a deviation from a reference under the condition; and a correction control section that determines whether the deviation of the temporary detection exceeds a predetermined threshold value or not, and when the deviation exceeds the threshold value, executes the main detection to fully detect the deviation so as to correct the condition, wherein the correction control section controls to form the pattern for the temporary detection, the number of the color components for the temporary detection being fewer than those of the patterns to be used for the main detection.

10 Claims, 9 Drawing Sheets

IMAGE FORMING APPARATUS AND CORRECTION METHOD OF IMAGE FORMING CONDITION

CROSS-REFERENCE TO RELATED APPLICATION

This application is related to Japanese application No. 2006-323971 filed on Nov. 30, 2006 whose priority is claimed under 35 USC§119, the disclosure of which is incorporated by reference in its entirety.

BACKGROUND OF THE INVENTION

1. Field of the Invention

The present invention relates to an image forming apparatus that can correct a condition for forming an image, and a correction method of an image forming condition.

2. Description of the Related Art

There has been known a color image forming apparatus that forms images of a plurality of color components, superimposes these images, and outputs the resultant image. In a color image forming apparatus described above, it is important, in order to obtain an excellent image quality, to form images of the respective color components under a predetermined condition. For example, a positional deviation (color misregistration) upon superimposing images of the respective color components corresponds to the image quality. Alternatively, keeping the density of each image of each color component to be a predetermined density corresponds to the image quality. Color misregistration is inherent to a color image. A great color misregistration might be evaluated as a poor image quality. When there is unevenness in the density of each color component, a sense of congruity occurs in a hue. In order to keep the image quality to be in a predetermined state, a technique has been performed in which a pattern is formed after a lapse of predetermined time, and this pattern is read to detect a misregistration amount from a reference for correcting a condition for forming an image. In order to make the misregistration amount small, it is preferable that the correction for the misregistration amount is carried out in a short interval. However, it takes much time to detect the misregistration amount, since the misregistration amount is detected by forming a pattern. Further, toner or ink, which is used to form an image, is consumed for forming a pattern. Even if a consumption amount of toner is small in one correction, the consumption amount reaches a non-negligible amount when the correction of the misregistration amount is frequently repeated. In the case of a user who mostly forms a monochrome image, for example, a color toner or the like is consumed although he/she rarely forms a color image. This situation is unreasonable. In particular, cost for a color toner is more expensive than the cost for a black toner used for monochrome image formation in most cases. A problem of who is to pay the toner expense used for the pattern formation is likely to arise.

As one technique for reducing the unreasonableness described above, a technique has been proposed in which a preliminary check is executed for confirming a degree of color misregistration, when the time for correcting color misregistration has come, and when the color misregistration is great, the correction described above is executed (e.g., see Japanese Unexamined Patent Application No. 2005-202110)

As described above, a technique for shortening a time taken for the correction of the image quality has conventionally been discussed. On the other hand, a demand for the image quality of a color image has more and more increased. The detection of the misregistration amount and the correction are inevitable. A technique capable of reducing a processing time taken for the correction and a consumption amount of toner or the like without reducing a frequency for performing a correction of a misregistration amount has been demanded.

On the other hand, a color image forming apparatus generally forms a color image by using four color components of yellow, magenta, cyan, and black. Some apparatuses provide an extended color reproduction area or satisfactory halftone capability with the use of more color components. In either case, a pattern should be formed for each color component so as to detect the misregistration amount from a reference, in order to correct an image quality.

Considering the consumption amount of each color component, the toners exclusively used for a color image formation, such as yellow, magenta, cyan, or the like, tend to be consumed uniformly compared to a black toner used also for a monochrome image formation. It is found from a commercial distribution manner of a color toner that each of the colors is frequently available as one set. However, since the composition ratio of each color component is different depending upon an image, the consumption amount is not always the same. Even so, if any one of the colors of the color components is consumed, the color image formation cannot help being inhibited. From this viewpoint, toners exclusively used for the color image formation are preferably consumed equally.

SUMMARY OF THE INVENTION

The present invention is accomplished in view of the foregoing circumstance, and aims to provide a more reasonable technique that can reduce a consumption amount of toner required to the correction of an image quality and/or a processing time without reducing a frequency of correcting an image quality.

The present invention provides an image forming apparatus including: a plurality of image forming sections, each image forming section being capable of forming an image of a color component among plural color components under a predetermined condition, and forming a pattern of each color component for adjusting the condition; an output section that transfers the formed images onto a recording sheet as the images being superimposed; a detecting section that reads the formed patterns of the respective color components so as to perform a temporary detection and a main detection of a deviation from a reference under the condition; and a correction control section that determines whether the deviation detected as a result of the temporary detection exceeds a predetermined threshold value or not, and when the deviation exceeds the threshold value, executes the main detection to fully detect the deviation so as to correct the condition on the basis of the detected deviation, wherein the correction control section controls each of the image forming sections to form one or more patterns of one or more color components for the temporary detection, the number of the color components for the temporary detection being fewer than those of the patterns to be used for the main detection.

From another aspect, the present invention provides a method for correcting an image forming condition in an image forming apparatus that can form images of plural color components respectively under a predetermined condition, and can form patterns of the color components respectively for adjusting the condition, the method including causing a computer to execute the steps of: forming one or more patterns of one or more color components for a temporary detection by using one or more image forming sections; reading the pattern(s) so as to perform the temporary detection of a deviation from a reference of the condition; determining whether the deviation detected by the temporary detection exceeds a predetermined threshold value or not; and performing a main detection by forming patterns of plural color components when the deviation exceeds the threshold value to fully detect the deviation to correct the condition on the basis of the deviation detected by the main detection, wherein the number of the color components for the temporary detection is fewer than those of patterns to be used for the main detection.

Since the correction control section controls each of the image forming sections to form one or more patterns of one or more color components for the temporary detection, in which the number of the color components for the temporary detection is fewer than those of the patterns to be used for the main detection, the image forming apparatus according to the present invention can reduce the consumption amount of toner required to the correction of an image quality and/or a processing time without reducing a frequency of correction, compared to a case in which only the main detection is executed every time.

DETAILED DESCRIPTION OF THE PREFERRED EMBODIMENTS

Figure 1:
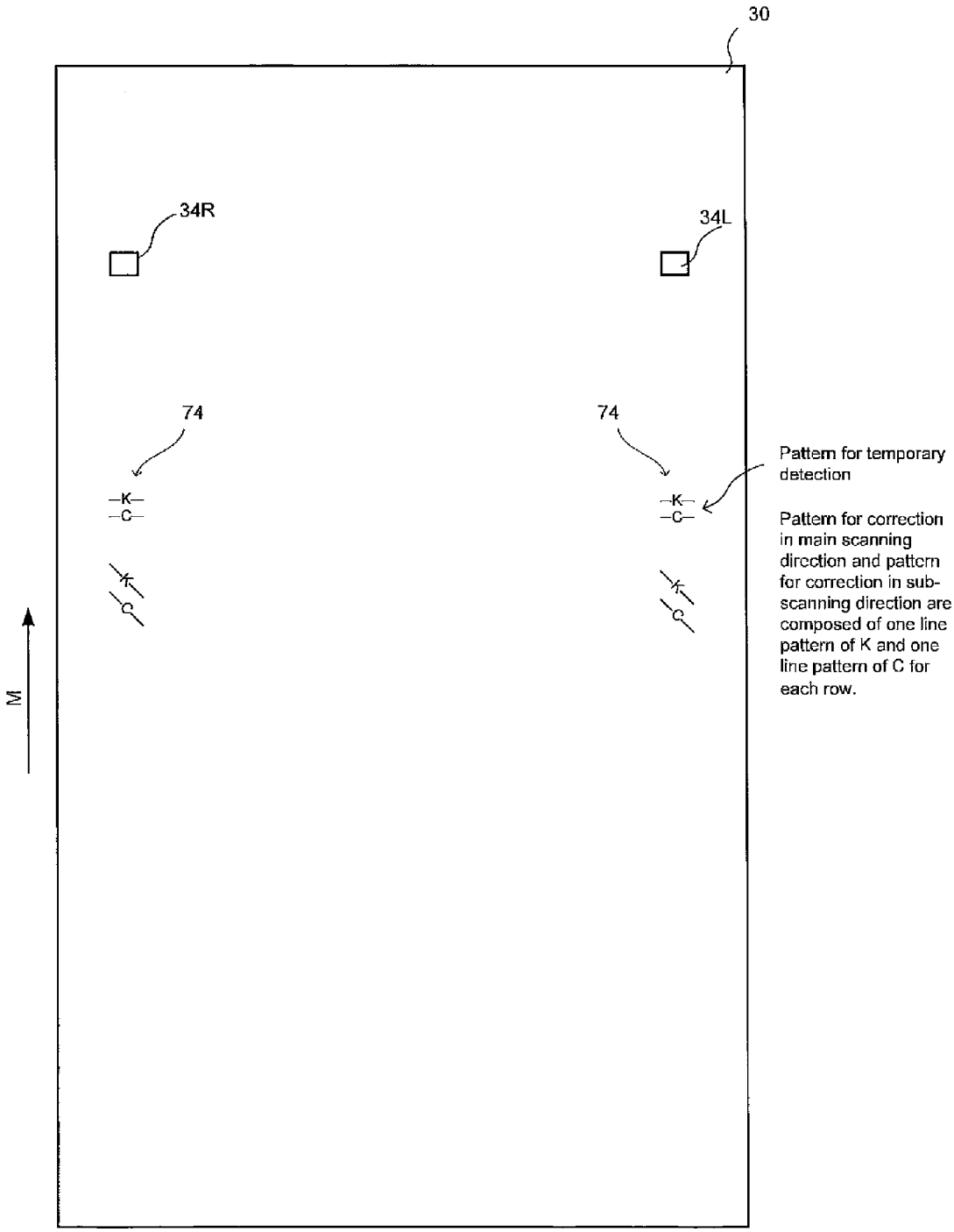
FIG. 1 is an explanatory view showing an example of a pattern for a temporary detection formed on an intermediate transfer belt in an image forming apparatus according to the present invention.

A preferable embodiment of the present invention will be described below.

In the image forming apparatus according to the present invention, the condition may be a forming position of each image for superimposing the images of the respective color components with a predetermined positional relationship. By virtue of this configuration, a correction of the color misregistration can be executed, while reducing the consumption amount of toner required to the correction of an image quality and/or a processing time without reducing a frequency of correction, compared to the case in which only the main detection is executed every time.

Further, the correction control section may control each of the image forming sections to form the pattern for the temporary detection for the corresponding color component with a partial pattern of the pattern for the main detection of the corresponding color component. By virtue of this configuration, a correction of the color misregistration can be executed, while reducing the consumption amount of toner required to the correction of an image quality and/or a processing time without reducing a frequency of correction, compared to the case in which only the main detection is executed every time.

Furthermore, each of the image forming sections may form an image by using a toner of a color corresponding to each color component, and the correction control section may control each of the image forming sections so that it forms the pattern for the temporary detection by using at least a toner having the greatest remaining amount among toners exclusively used for a color image. Since the toner having the greatest remaining amount and exclusively used for the color image formation is used to form the pattern, the toner exclusively used for the color image formation can be consumed more equally. Therefore, compared to the case in which toners of each color are equally used to form a pattern, the period when any one of the toners exclusively used for the color image formation is consumed so that the color image formation is impossible can be delayed.

Alternatively, each image may include a plurality of pixels, the image forming apparatus may further include a color pixel count unit that counts pixels of each color component, each of the image forming sections may form an image by using a toner of a color corresponding to each color component, the color pixel count unit may count the total pixel number of the image of each color component formed after a reference point at which toner of each color is charged, and the correction control section may control the image forming sections to form the pattern for the temporary detection by using at least a color component having the smallest total pixel number among color components exclusively used for the color image. Since the pattern is formed by using the toner of the color component having the smallest total pixel number, the toner exclusively used for the color image formation can be consumed more equally. Therefore, compared to the case in which toners of each color are equally used to form a pattern, the period when any one of the toners exclusively used for the color image formation is consumed so that the color image formation is impossible can be delayed.

The image forming apparatus according to the present invention may be the color components may include at least black, cyan, magenta and yellow ones.

Alternatively, the color components may include at least black, cyan, magenta and yellow ones, and the detecting section may define black as a reference color, and may perform the temporary detection and the main detection of the deviation of the other color components from the reference color.

Further, each of the image forming sections may be serially arranged in the order in which the images of the respective color components are superimposed over one another, the detecting section may define one color component as a reference color, and may perform the temporary detection and the main detection of the deviation of the other color components from the reference color, and the threshold value may be different for every color component, wherein a greater threshold value may be set for the color component whose image forming section is arranged more apart from the image forming section of the reference color. The color misregistration amount of the color component whose image forming section is apart from the image forming section for the reference color tends to increase. By virtue of this configuration, the threshold value of each color component can be appropriated.

Further, the correction control section may control each of the image forming sections so that it forms the pattern for the temporary detection by using at least a color component whose image forming section is arranged apart from the image forming section of a reference color. By virtue of this configuration, the temporary detection is executed by using the color component that has a tendency of having the greatest misregistration amount detected, whereby whether the correction is needed or not can more correctly be determined.

Each of the various preferable embodiments indicated here can be combined.

The present invention will be explained in detail below with reference to the drawings. It should be understood that the following description is illustrative of the invention in all aspects, but not limitative of the invention.

(Overall Functional Configuration of Image Forming Apparatus)

Figure 2:
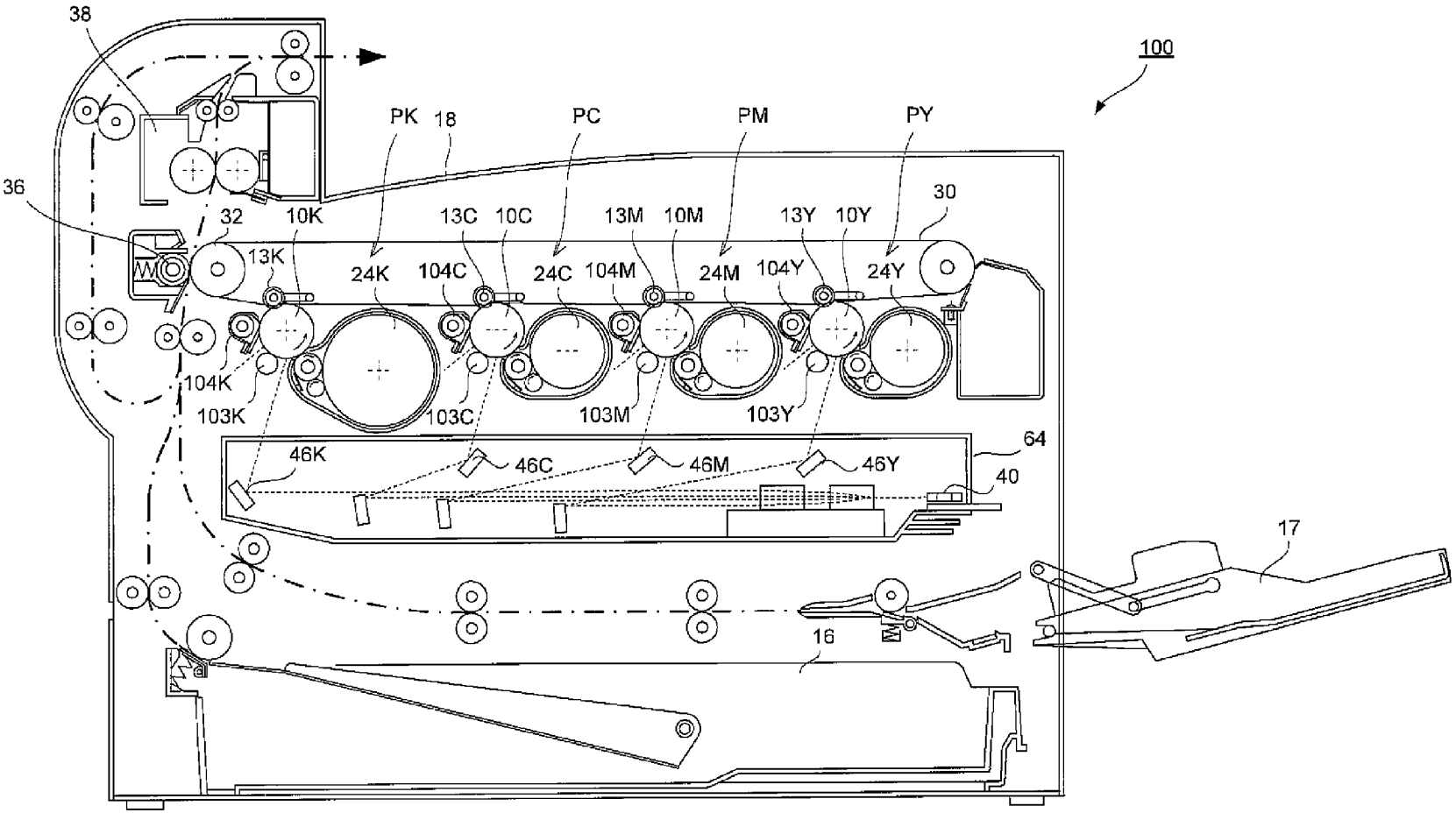
FIG. 2 is an explanatory view showing the configuration of the image forming apparatus according to the embodiment of the present invention.

Firstly, an example of a functional configuration of an image forming apparatus according to the present invention will be explained. Particularly, specific configurations of the image forming section and the output section will be explained. FIG. 2 is an explanatory view showing a configuration of an image forming apparatus according to an embodiment of the present invention. An image forming apparatus 100 is an electrophotographic color image forming apparatus that forms a multi-color image on a recording sheet such as a paper according to image data externally transferred. Further the image forming apparatus 100 may form a mono-color image on a recording sheet. The image forming apparatus 100 includes an exposure unit 64, photoconductor drums 10 (10Y, 10M, 10C, 10K), developing units 24 (24Y, 24M, 24C, 24K), charging rollers 103 (103Y, 103M, 103C, 103K), cleaning units 104 (104Y, 104M, 104C, 104K), an intermediate transfer belt 30, intermediate transfer rollers (hereinafter simply referred to as a transfer roller) 13 (13Y, 13M, 13C, 13K), a secondary transfer roller 36, a fusing device 38, a sheet feeding cassette 16, a manual sheet feeding tray 17, and a sheet exit tray 18.

The photoconductor drum 10, the developing unit 24, the charging roller 103, and the cleaning unit 104 for each color component correspond to the image forming section of the present invention.

The intermediate transfer belt 30, the intermediate transfer roller 13, the secondary transfer roller 36, the fusing device 38, the sheet feeding cassette 16, the manual sheet feeding tray 17, and the sheet exit tray 18 correspond to the output section of the present invention.

The image forming apparatus 100 forms an image by using image data corresponding to each of four color components that are cyan (C), magenta (M), and yellow (Y), which are three primary colors of a subtractive mixture of a color image, and black (K). Four photoconductor drums 10 (10Y, 10M, 10C, 10K), four developing units 24 (24Y, 24M, 24C, 24K), four charging rollers 103 (103Y, 103M, 103C, 103K), four intermediate transfer rollers (13Y, 13M, 13C, 13K), and four cleaning units 104 (104Y, 104M, 104C, 104K) are provided so as to correspond to each color component, and they constitute four image forming sections PK, PC, PM, and PY. The image forming sections PK, PC, PM, and PY are arranged in a line in the moving direction (sub-scanning direction) of the intermediate transfer belt 30. The alphabets Y, M, C, and K appended at the end of each numeral for each part correspond to each color component. Specifically, Y corresponds to yellow, M corresponds to magenta, C corresponds to cyan, and K corresponds to black, respectively. The explanation using the numerals in which the alphabets at the end are omitted can be applied to all color components.

The charging roller 103 is a contact-type charger for uniformly charging the surface of the photoconductor drum 10 to a predetermined potential. Instead of the charging roller 103, the contact-type charger using a charging brush or a contact-type charger using a corona charger can be used. An exposure unit (sometimes referred to as LSU or laser scanning unit) 64 includes laser diodes not shown in FIG. 2, a polygon mirror 40, and reflection mirrors 46 (46Y, 46M, 46C, 46K). The laser diodes are provided so as to correspond to the respective color components, and laser beams modulated according to image data of each color component of black, cyan, magenta and yellow are irradiated from the respective laser diodes. Each of the laser beams irradiates the surface of the photoconductor drum 10 uniformly charged by the charging roller 103. Accordingly, an electrostatic latent image according to the image data of each color component is formed on the surface of the photoconductor drum 10. Specifically, electrostatic latent images corresponding to image data of yellow, magenta, cyan, and black are formed on the photoconductor drums 10Y, 10M, 10C, and 10K.

The developing unit 24 develops the electrostatic latent image formed on each photoconductor drum 10 by toner corresponding to each color component. As a result, a visualized image (toner image) of each color component is formed on the surface of each photoconductor drum 10. In the case of forming a monochrome image, an electrostatic latent image is formed only on the photoconductor drum 10K so as to form only a black toner image. In the case of forming a color image, electrostatic latent images are formed on the photoconductor drums 10Y, 10M, 10C, and 10K so as to form toner images of yellow, magenta, cyan, and black.

A toner storing chamber for storing toner is provided to each developing unit 24. The toner in the toner storing chamber decreases with the development. The toner storing chamber in the developing unit 24 is provided with a toner remaining amount sensor that can detect the remaining amount of toner stored in the toner storing chamber at multi-stages. Alternatively, the toner storing chamber may be provided with a toner empty sensor for detecting that the toner in the toner storing chamber is consumed and the toner storing chamber becomes empty. When the toner remaining amount sensor or the toner empty sensor detects the empty state, the image formation using this color is inhibited, and an alarm is displayed on an unillustrated display unit to urge a user to exchange the toner storing chamber. When the user removes the empty toner storing chamber from the image forming apparatus 100 and installs a new toner storing chamber, an alarm display is turned off, so that the inhibited image formation can be executed.

An optical type or piezoelectric vibration type has been known as the toner remaining amount sensor or empty sensor. The optical type includes a light-emitting unit at a frame at one side of the toner storing chamber and a light-receiving unit at a frame at the other side, wherein it determines whether the toner storing chamber is empty or not according to the presence/absence of transmitted light from the light-emitting unit to the light-receiving unit (e.g., see FIGS. 5 to 7 in Japanese Unexamined Patent Application No. 2002-156820). The toner level sensor (model type: LTS or TSP series) manufactured by TDK Corporation has been known as the piezoelectric vibration type. This type utilizes the change in the impedance characteristic of a piezoelectric device according to whether toner is in contact with the detecting surface of the piezoelectric vibration sensor, i.e., whether load is applied to the detecting surface of the piezoelectric vibration sensor. By arranging this type of sensor at the bottom part of the toner storing chamber, the consumption of toner can be detected.

The intermediate transfer roller 13 transfers each toner image onto the intermediate transfer belt 30 by the action of the transfer voltage applied thereto. The intermediate transfer belt 30 moves from the intermediate transfer roller 13Y to the intermediate transfer roller 13K. In the case of forming a color image, each of the toner images of yellow, magenta, cyan, and black are superimposed on the intermediate transfer belt 30 in this order with the movement of the intermediate transfer belt 30. The superimposed toner image passes through the portion where the secondary transfer roller 36 is arranged. At this time, a recording sheet is fed from the sheet feeding cassette 16 or the manual sheet feeding tray 17 so as to be in synchronism with the timing of the passage of the toner image. The fed recording sheet is conveyed between the intermediate transfer belt 30 and the secondary transfer roller 36 so as to be in contact with the toner image. The secondary transfer roller 36 transfers the toner image onto the recording sheet by the action of the secondary transfer voltage applied thereto. The recording sheet having the toner image transferred thereon is discharged onto the sheet exit tray 18 through the fusing device 38. The fusing device 38 fuses the toner image to be fixed onto the recording sheet, when the recording sheet passes through the fusing device 38.

(Configuration of Essential Part of Image Forming Apparatus)

Next, the configuration of an essential part of the image forming apparatus will be explained. Also, a hardware configuration of the detecting section and the correction control section will be explained.

Figure 3:
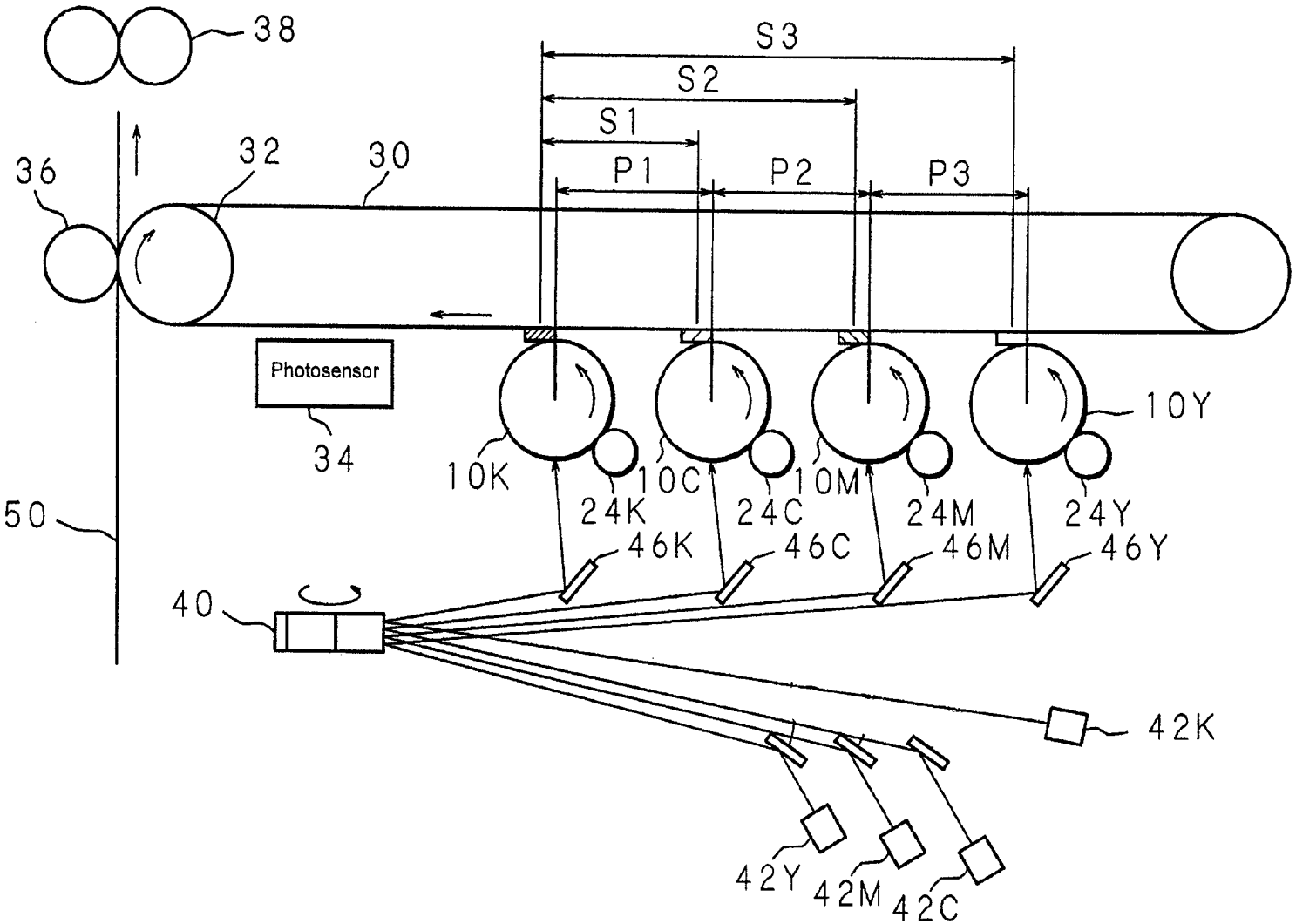
FIG. 3 is an explanatory view schematically showing the functional configuration of an essential part of the image forming apparatus according to the present invention.

FIG. 3 is an explanatory view schematically showing a functional configuration of an essential part of the image forming apparatus according to the present invention.

The intermediate transfer belt 30 in an endless state is driven by a belt drive roller 32 that rotates in the clockwise direction in the figure. A photosensor 34 is arranged below the intermediate transfer belt 30 so as to face the surface thereof. The photosensor 34 is arranged at the downstream side of the photoconductor drum 10K along the moving direction of the intermediate transfer belt 30, i.e., between the photoconductor drum 10K and the secondary transfer roller 36.

In addition, the secondary transfer roller 36 is arranged so as to face the belt drive roller 32 with the intermediate transfer belt 30 sandwiched between them. The recording sheet 50 fed from the sheet feeding cassette 16 or the manual sheet feeding tray 17 passes between the secondary transfer roller 36 and the intermediate transfer belt 30.

Figure 4:
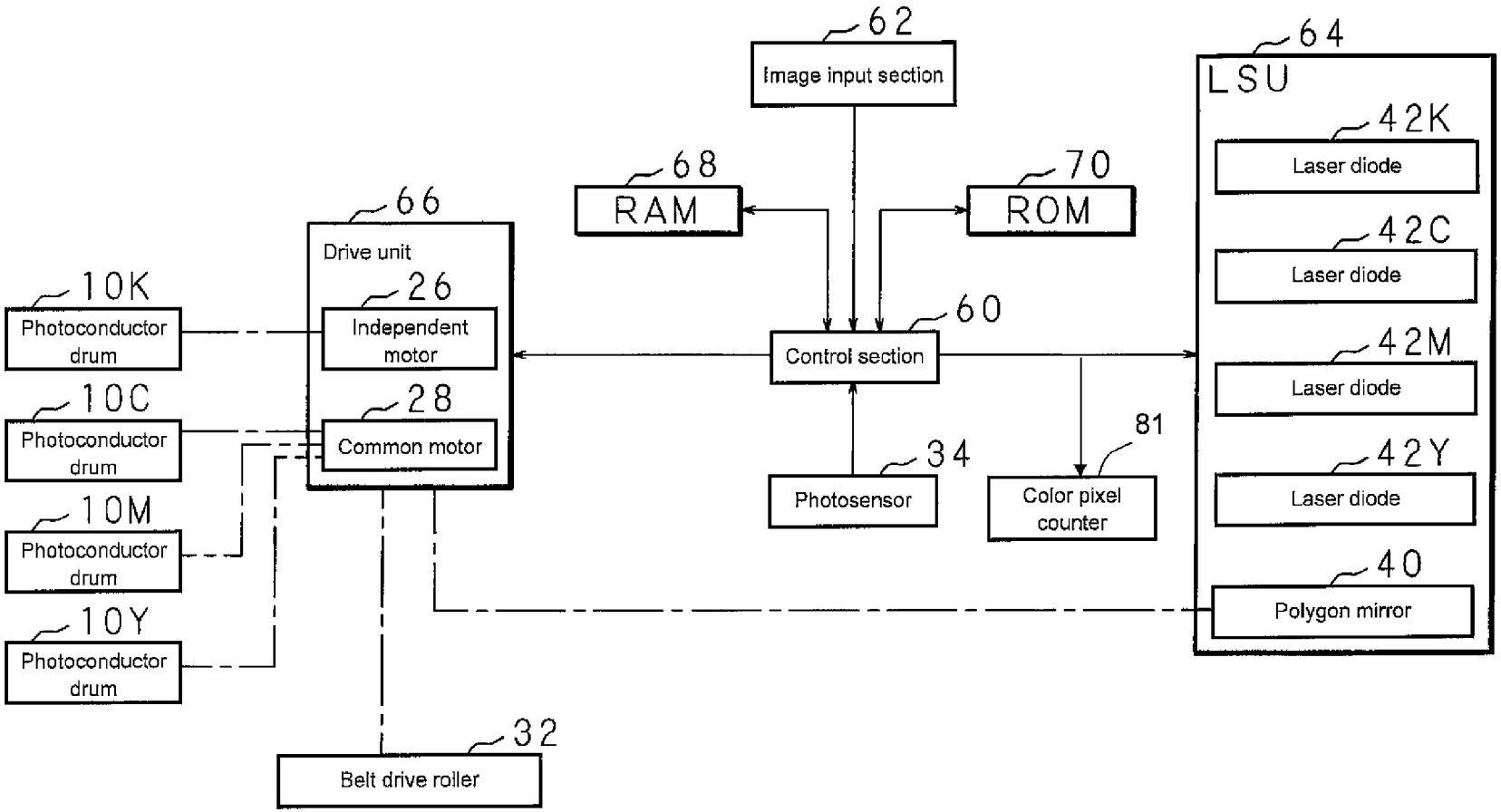
FIG. 4 is a block diagram showing an electrical configuration of the essential part of the image forming apparatus according to the present invention.

FIG. 4 is a block diagram showing an electrical structure of the essential part of the image forming apparatus according to the present invention. As shown in FIG. 4, the image forming apparatus 100 includes the photosensor 34 serving as an input section and an image input section 62. It also includes the LSU 64 and a drive section 66 that are the subject to be controlled. It also includes a control section 60, a RAM 68, and a ROM 70 for processing a signal or data from the input section and controlling the subject to be controlled. The image forming apparatus 100 also includes the photoconductor drums 10K, 10C, 10M, and 10Y, belt drive roller 32, and polygon mirror 40 that are driving loads. Further, it includes a color pixel counter 81.

The photosensor 34 coupled with the function realized by the control section 60 corresponds to the detecting section of the present invention. The control section 60, the RAM 68 and the ROM 70 correspond to the correction control section of the present invention.

The photosensor 34 is a sensor for reading a pattern formed on the intermediate transfer belt 30. The image input section 62 acquires the image data of the image, which should be outputted, from the outside. The source that provides the image data is a device connected to the image forming apparatus 100 via a communication line. One example of the device is a host of a personal computer. Another example of the device is an image scanner. The acquired image data is stored in the RAM 68 for printing process.

The control section 60 is specifically a CPU or a microcomputer. The RAM 68 provides an operation work area or an area as an image memory storing the image data to the control section. The information indicating the attribute of the image data is attached to the image data acquired from the image input section 62. The attached attribute includes length and breadth of each image, a type of monochrome image or color image, or the like. The control section 60 stores the acquired image data into the RAM 68 so as to associate with the attached attribute. The image data is stored in the RAM 68 by every Job. If one job is composed of plural pages, the image data is stored in a page unit. When the image data is inputted from an external host with a format of a page description language, the control section 60 develops the inputted image data and stores the same in the image memory.

The ROM 70 stores a program that specifies the procedure executed by the control section 60. The ROM 70 further stores pattern data for producing the pattern. The control section 60 controls the drive of the illustrated driving loads shown in the figure. The control section 60 also controls the operation of each unit, which is the constituent of the image forming apparatus 100 and not shown in FIG. 4.

The LSU 64 receives a signal (pixel signal) on the basis of the image data stored in the image memory area in the RAM 68 through an image processing section not shown. The image processing section processes the image data and provides a modulation signal according to each pixel of the image to be outputted to the LSU 64. The modulation signal is provided every color components of yellow, magenta, cyan, and black. The yellow modulation signal is used to modulate the light emission of the laser diode 42Y arranged in the LSU 64. Each of the modulation signals of magenta, cyan, and black is used to modulate the light emissions of the laser diodes 42M, 42C, and 42K in the LSU 64 respectively.

The drive section 66 includes an individual motor 26 and a common motor 28. The individual motor 26 is a motor for driving the photoconductor drum 10K. The common motor 28 drives the photoconductor drums 10C, 10M and 10Y as a common driving source for the photoconductor drums 10C, 10M, 10Y. Further, the drive section 66 includes a motor (not shown) for driving the belt drive roller 32 and a motor (not shown) for driving the polygon mirror 40. The control section 60 controls a motor for driving the loads of a surface of the photoconductor drum 10 and the intermediate transfer belt 30 in such a manner that the peripheral surface of the photoconductor drum 10 and the peripheral surface of the intermediate transfer belt 30 move at the same constant speed.

The color pixel counter 81 counts, for every color component of yellow, magenta, cyan, and black, a pixel number of the image from the state in which the toner is full. The color pixel counter corresponds to the color pixel count unit of the present invention. The color pixel counter 81 is not the essential component in the image forming apparatus according to the present invention.

Figure 9:
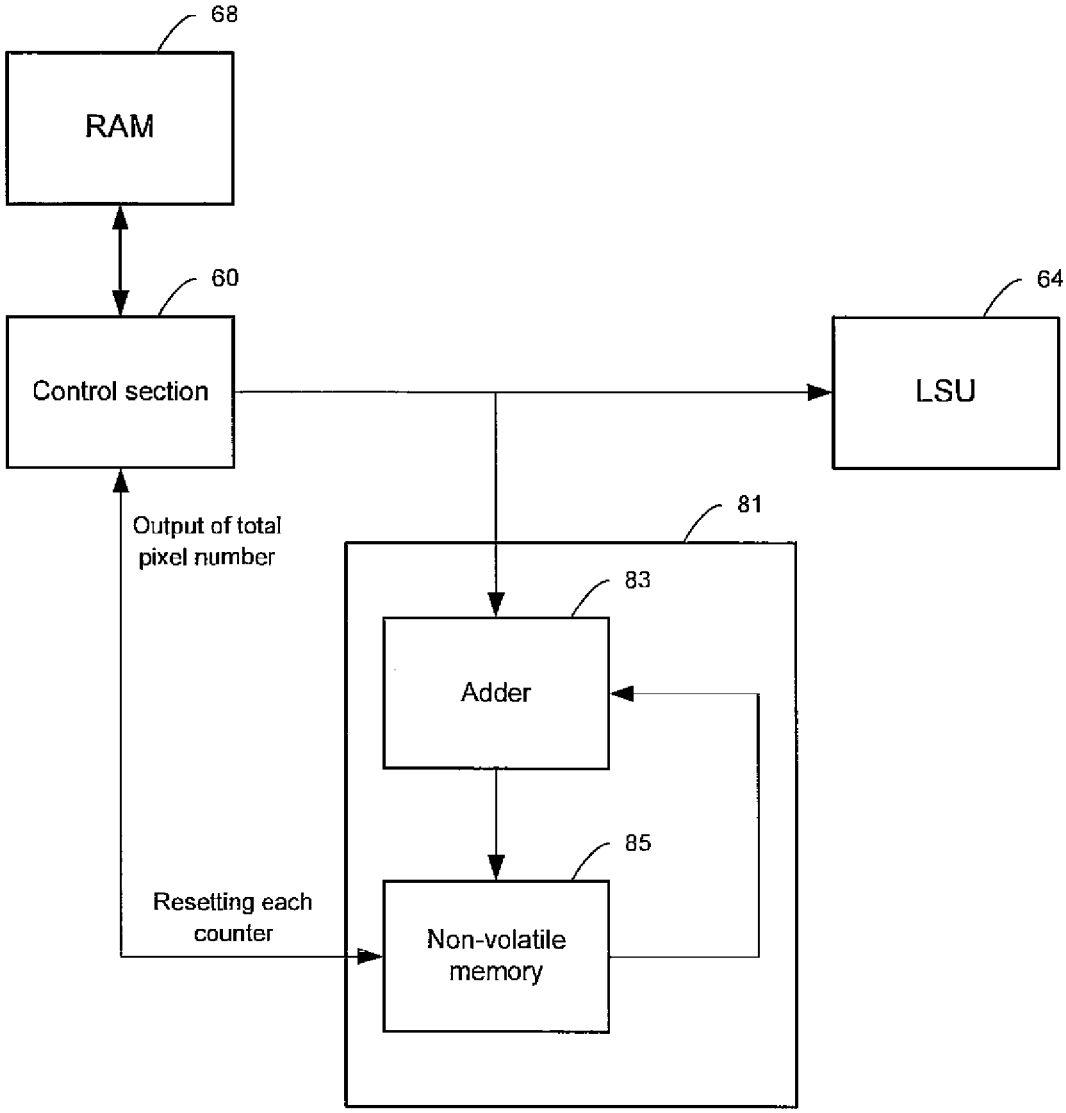
FIG. 9 is a block diagram showing a detail of a color pixel counter provided in the image forming apparatus according to the present invention.

FIG. 9 is a block diagram showing the detail of the color pixel counter 81. As shown in FIG. 9, the color pixel counter includes an adder 83 and a non-volatile memory 85. The non-volatile memory 85 has counter areas for every color component of yellow, magenta, cyan, and black. Each of the counter areas stores the result (pixel count number) obtained by counting the pixels of the corresponding color component. When the pixel signal of each color component stored in the image memory in the RAM 68 is transferred to the LSU 64 through the control of the control section 60, the pixel signal is also inputted to the adder 83. The adder counts the pixel signal, which is transferred to the LSU 64, for every color component, and adds the counting result to each pixel count value in the counter area in the non-volatile memory 85.

The control section 60 can read the content in the counter area in the non-volatile memory 85, and acquire each of the pixel count value. Further, the control section 60 can reset the counter area. The control section 60 resets the pixel count value of the exchanged color component, when the toner storing chamber in the image forming apparatus 100 is exchanged.

(Formation of Pattern, Procedure of Main Detection and Correction)

Explanation will be given to a formation of the pattern executed in the image forming apparatus, main detection of the formed pattern, and a procedure of correction based on a result of the main detection. In a correction procedure as will be described below, the processing is executed by the detecting section and the correction control section cooperatively.

When a pattern is formed, the control section 60 acquires pattern data stored beforehand in the ROM 70. The control section 60 expands the acquired pattern data in the image memory area so as to prepare the pattern. The control unit determines and selects the color component whose pattern is prepared. Thereafter, the data of the expanded pattern is transferred to the LSU 64. The laser diode of the color component that receives the data forms the electrostatic latent image of the pattern on the photoconductor drum. The developing unit develops the formed electrostatic latent image to form the toner image of the pattern. The toner image of each color component is transferred onto the intermediate transfer belt 30.

The photosensor 34 reads the formed pattern of each color component. The control section 60 executes the correction of an image on the basis of the information obtained from the read pattern of each color component.

The image correction will be explained below taking the main detection for the correction of color misregistration as an example. The control section 60 obtains the misregistration amount of the read pattern of each color component with respect to the reference position by the photosensor 34. The control section 60 may define a specific color component as a reference color, and define the position of the pattern of the reference color as the reference position. Alternatively, the control section 60 may define the pattern of the reference color formed on the intermediate transfer belt 30 separate from the pattern as the reference position.

When the pattern for the main detection is formed, the control section 60 controls the laser diodes 42 of the color components to simultaneously emit light beam so as to simultaneously start to expose the photoconductor drums 10. With this operation, the patterns of black, cyan, magenta, and yellow are transferred onto the intermediate transfer belt 30 at the same timing. In this case, the space between each pattern transferred onto the intermediate transfer belt 30 and the space between each photoconductor drum 10 becomes equal. As shown in FIG. 3, the space between the photoconductor drums 10K and 10C is P1. The space between the photoconductor drums 10C and 10M is P2. The space between the photoconductor drums 10M and 10Y is P3.

Figure 5:
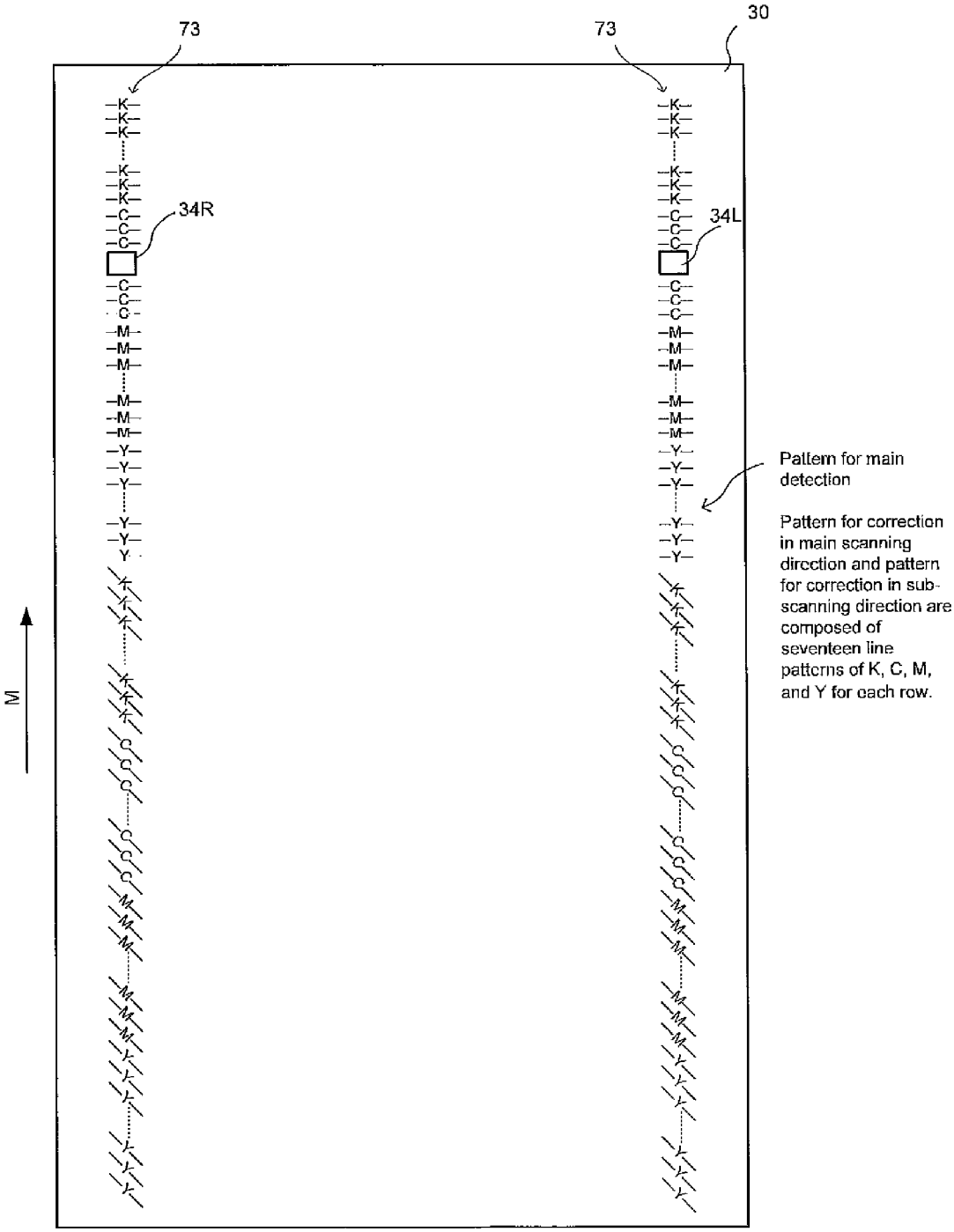
FIG. 5 is an explanatory view showing one example of a pattern for a main detection formed on an intermediate transfer belt in the image forming apparatus according to the present invention.

Next, the procedure that the control section 60 obtains the position of the patterns of the color components will be described in detail. FIG. 5 is an explanatory view showing one example of a pattern for the main detection formed on the intermediate transfer belt 30. FIG. 1 is a view in which the intermediate transfer belt 30 is viewed from below, and the intermediate transfer belt 30 moves from the bottom part to the upper part (in the direction of arrow M) in FIG. 5. The photosensors 34L and 34R are reflective-type photosensors, and arranged so as to be opposite to the intermediate transfer belt 30. The two photosensors 34 L and 34R are aligned on a straight line extending in the widthwise direction, as well as arranged at both ends of the intermediate transfer belt 30. As shown in FIG. 5, the pattern 73 for the main detection is formed at both end portions of the intermediate transfer belt 30. The pattern of each color component at one end is composed of a set of seventeen line patterns arranged in the moving direction of the intermediate transfer belt 30. Therefore, thirty-four line patterns in total are arranged at both end portions. The length of seventeen line patterns arranged in the moving direction generally equals to the peripheral length of the photoconductor drum 10. The characters K, C, M, and Y are appended for indicating the color of each line pattern in FIG. 5 for explanation, but the actual pattern is a simple line pattern not including the character pattern. The line patterns, among the line patterns shown in FIG. 5, extending in parallel to the widthwise direction are patterns (patterns for the correction in the sub-scanning direction) for correcting the image forming position in the moving direction. The line patterns extending diagonally at an angle of 45 degrees are patterns (patterns for the correction in the main scanning direction) for correcting the image forming position in the widthwise direction.

The control section 60 obtains, from the signal from the photosensor 34, the timing of the passage of the leading end and trailing end of each line pattern when the line pattern passes through the photosensor 34. The average value of the obtained leading-end passage timing and the trailing-end passage timing is defined as the timing at which the center of each line pattern passes. The control section 60 temporarily stores the passage timing of each line pattern obtained described above in the RAM 68.

As shown in FIG. 5, seventeen line patterns are aligned in the pattern of each color component. The control section 60 may obtain the average of the passage timings of seventeen line patterns, and define the obtained average value as the timing corresponding to the forming position of each color component. The control section 60 calculates the time corresponding to the spaces S1, S2, and S3 of the patterns of the color components shown in FIG. 3 from the obtained timing and the moving speed of the intermediate transfer belt 30. The space S1 is a space between the pattern of the reference color (black) and the pattern of cyan. The space S2 is a space between the pattern of the reference color (black) and the pattern of magenta. The space S3 is a space between the pattern of the reference color (black) and the pattern of yellow.

Next, the positional correction in the sub-scanning direction when black is defined as a reference color will be explained. The control section 60 corrects the space S1 to coincide with the space P1 (see FIG. 3) between the black photoconductor drum 10K and cyan photoconductor drum 10C. Specifically, the control section 60 corrects the forming position of the cyan image in the following image formation in such a manner that the difference between the space S1 and the space P1 becomes not more than a predetermined threshold value. The space P1 is a predetermined value. The forming position is corrected by changing the light-emission starting timing of the laser diode 42C. More specifically, the correction in the sub-scanning direction is realized by changing the light-emission timing per a scanning line.

The control section 60 also corrects the space S2 to coincide with the space (P1+P2) between the black photoconductor drum 10K and the magenta photoconductor drum 10M. Specifically, the control section 60 corrects the forming position of the magenta image in the following image formation in such a manner that the difference between the space S2 and the space (P1+P2) becomes not more than a predetermined threshold value. The space P2 is a predetermined value like P1. The forming position is corrected by adjusting the light-emission starting timing of the laser diode 42M.

The control section 60 also corrects the space S3 to coincide with the space (P1+P2+P3) between the black photoconductor drum 10K and the yellow photoconductor drum 10Y. Specifically, the control section 60 corrects the forming position of the yellow image in the following image formation in such a manner that the difference between the space S3 and the space (P1+P2+P3) becomes not more than a predetermined threshold value. The space P3 is a predetermined value like P1 and P2. The forming position is corrected by adjusting the light-emission starting timing of the laser diode 42Y.

Subsequently, the positional correction in the main scanning direction will be explained. The positional correction in the main scanning direction is performed after the correction amount in the sub-scanning direction is obtained. The control section 60 obtains the space between the pattern of the reference color (black) and the pattern of the other colors with respect to the pattern for the correction in the main scanning direction. The space between the pattern of the reference color (black) and the cyan pattern is defined as S1'. The space between the pattern of the reference color (black) and the magenta pattern is defined as S2'. The space between the pattern of the reference color (black) and the yellow pattern is defined as S3'. The obtained space is corrected with the use of the difference in the sub-scanning direction between the spaces S1, S2 and S3 and the reference. Specifically, when the corrected spaces are defined as S1", S2", and S3", $$S1''=S1'-(S1-P1)$$

$$S2''=S2'-\{S2-(P1+P2)\}$$

$$S3''=S3'-\{S3-(P1+P2+P3)\}$$

The control section 60 corrects the space S1" to coincide with the space P1. Specifically, the control section 60 corrects the forming position of the cyan image in the following image formation in such a manner that the difference between the space S1" and the space P1 becomes not more than a predetermined threshold value. The correction in the main and sub-scanning directions is realized by changing the light-emission start timing of the laser diode 42C in each scanning line. The control section 60 corrects the space S2' to coincide with the space (P1+P2). Specifically, the control section 60 corrects the forming position of the magenta image in the following image formation in such a manner that the difference between the space S2" and the space (P1+P2) becomes not more than a predetermined threshold value. Further, the control section 60 corrects the space S3" to coincide with the space (P1+P2+P3). Specifically, the control section 60 corrects the forming position of the yellow image in the following image formation in such a manner that the difference between the space S3" and the space (P1+P2+P3) becomes not more than a predetermined threshold value.

The control section 60 may adjust the transfer rate of the modulation signal in the main scanning direction such that the spaces S1", S2", and S3" obtained by reading the pattern for the correction in the main scanning direction becomes equal to one another between the photosensors 34L and 34R. This is the correction for matching the unevenness in the image magnification ratio of each color component in the main scanning direction.

(Procedure for Temporary Detection)

The execution of the temporary detection is the characteristic point in the present invention. The procedure for the temporary detection will be described below, although the explanation is out of sequence.

The image forming apparatus according to the present invention executes the temporary detection before the main detection. In the temporary detection, the pattern is also formed, and the formed pattern is read by the photosensors 34L and 34R. It is to be noted that the pattern for the temporary detection is different from the pattern for the main detection.

The pattern for the temporary detection is different from the pattern for the main detection in that the pattern for the temporary detection is formed by using some color components, although the pattern for the main detection is formed by using all color components. Further, the pattern for the temporary detection for each color component may be a partial pattern of the pattern for the main detection. Since the temporary detection is executed by using some color components of the main detection or using some patterns of the main detection as described above, the consumption amount of toner or the like and/or processing time can be reduced compared to the case in which the main detection is executed every time.

FIG. 1 is an explanatory view showing one example of a pattern for the temporary detection formed on the intermediate transfer belt 30 in the image forming apparatus according to the present invention. In the example shown in FIG. 1, the pattern 74 for the temporary detection is formed only of color components of black and cyan. The pattern 74 is composed of one line pattern at the right side and one line pattern at the left side for the correction in the main scanning direction for each color component and one pattern at the right side and one pattern at the left side for the correction in the sub-scanning direction for each component. Specifically, the pattern 74 for the temporary detection in FIG. 1 is composed of only some color components, with respect to the pattern 73 for the main detection in FIG. 5, and composed of only some patterns for each color component.

Figure 6:
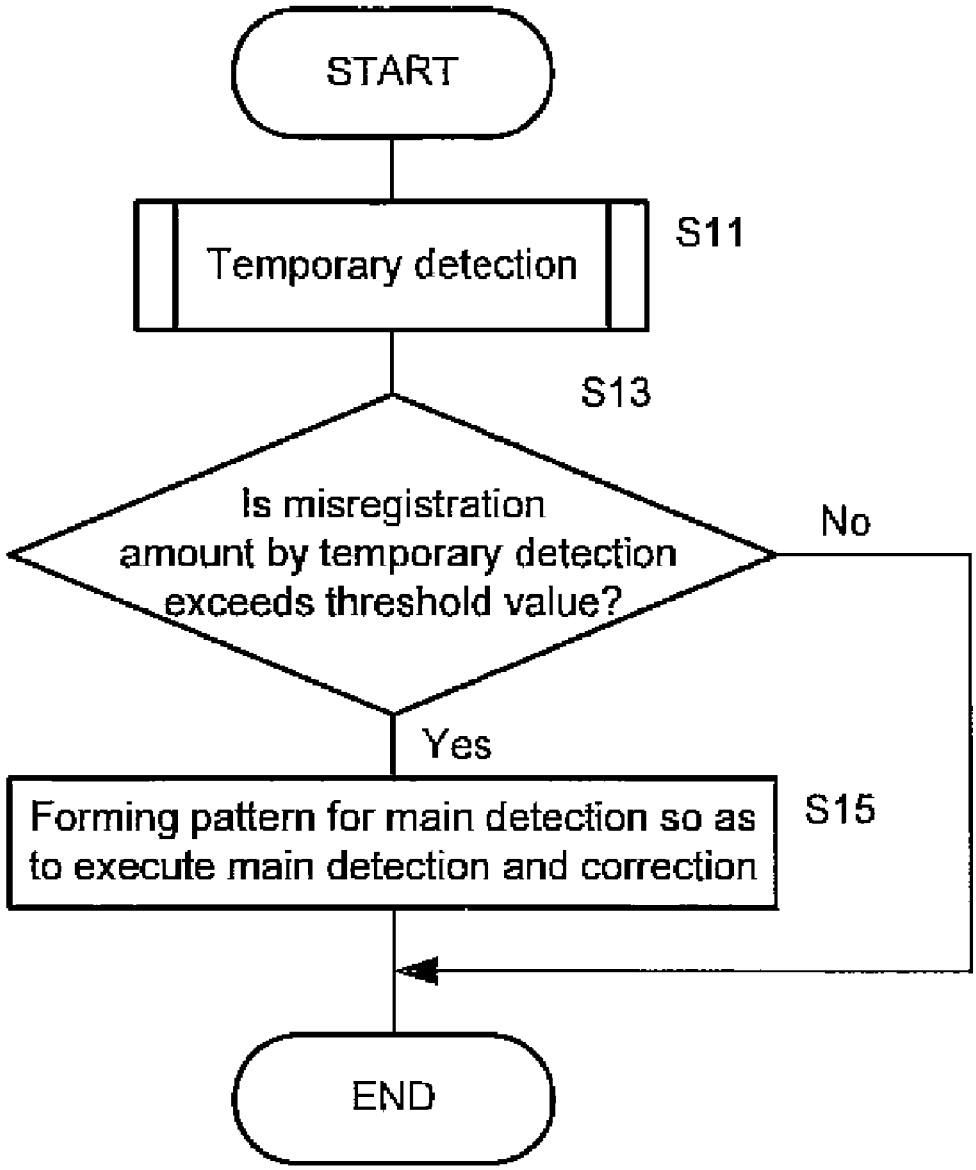
FIG. 6 is a flowchart showing procedures of the temporary detection and main detection executed by a control unit in the image forming apparatus according to the present invention.
Figure 7:
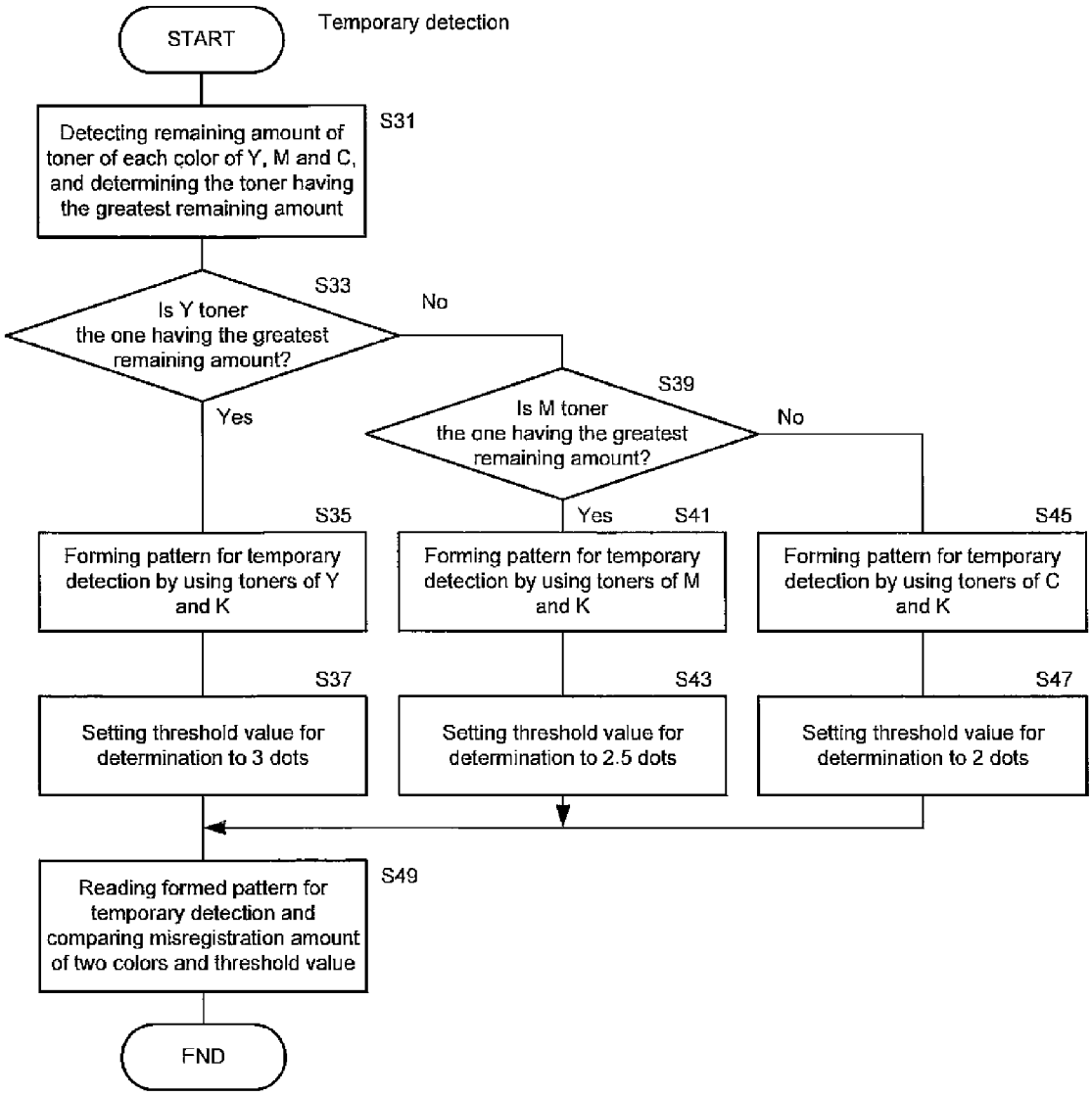
FIG. 7 is a flowchart showing a detailed procedure of the temporary detection executed by a control unit in the image forming apparatus according to the present invention.
Figure 8:
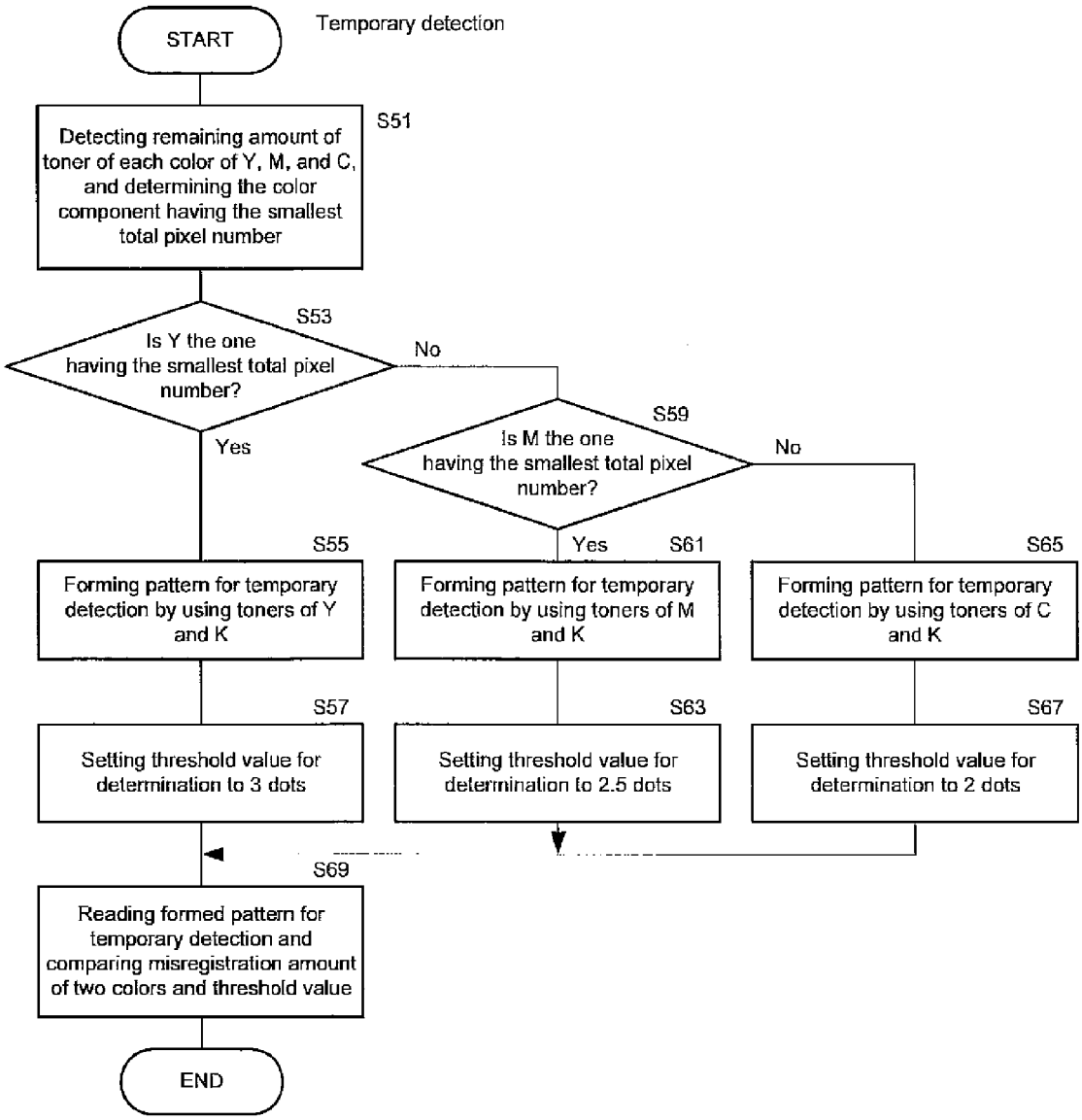
FIG. 8 is a flowchart showing a different procedure for the temporary detection executed by a control unit in the image forming apparatus according to the present invention.

FIGS. 6 and 7 are flowcharts showing the procedures of the temporary detection and main detection executed by the control section 60 according to the present embodiment. Firstly, FIG. 6 will be explained. In FIG. 6, the control section 60 executes the temporary detection when predetermined correction timing has come (step S11). The correction timing has come when, for example, a predetermined time has elapsed from the previous temporary detection. Alternatively, the correction timing has come when predetermined number of pages is outputted from the previous temporary detection. Alternatively, it may be determined that the correction timing has come on the basis of the combination of the above-mentioned cases. Further, it may be determined that the correction timing has come when the component closely related to an image, such as the photoconductor drum 10, is exchanged. The detailed procedure for the temporary detection is shown in FIG. 7 or 8, so that the explanation for the temporary detection is made with reference to FIG. 7 or 8.

The control section 60 determines whether the obtained misregistration amount exceeds the set threshold value or not on the basis of the result of the temporary detection (step S13). When the misregistration amount in the main scanning direction exceeds the threshold value or the misregistration amount in the sub-scanning direction exceeds the threshold value, the control section 60 determines that the misregistration amount exceeds the threshold value. When the control section 60 determines that the misregistration amount exceeds the threshold value, it executes the main detection. Specifically, the pattern 73 for the main detection is formed so as to detect the misregistration amount for each color component. Then, the forming position of the image for each color component is corrected on the basis of the detected misregistration amount (step S15).

On the other hand, the control section 60 determines that the misregistration amount does not exceed the threshold value as a result of the temporary detection, the control section 60 ends the process. Every time a predetermined timing has come, the control section 60 executes the process in FIG. 6.

FIG. 7 is a flowchart showing the detailed procedure of the process executed in the step S11. In FIG. 7, the control section 60 monitors the remaining amount of toner exclusively used for the color image, i.e., toner of yellow, magenta, and cyan, and specifies the toner having the greatest remaining amount (step S31).

When the toner having the greatest remaining amount is yellow (step S33), the pattern 74 for the temporary detection is formed by using the yellow toner and the black toner that is the reference color (step S35). The control section 60 also sets the threshold value used for the determination to the misregistration amount of 3 pixels (step S37). Then, the routine proceeds to step S49. On the other hand, when the toner having the greatest remaining amount is magenta (step S39), the pattern 74 for the temporary detection is formed by using the magenta toner and the black toner that is the reference color (step S41). The control section 60 also sets the threshold value used for the determination to the misregistration amount of 2.5 pixels (step S43). Then, the routine proceeds to step S49. When the determination at the step S39 is NO, i.e., when the toner having the greatest remaining amount is cyan, the pattern 74 for the temporary detection is formed by using the cyan toner and the black toner that is the reference color (step S45). The control section 60 also sets the threshold value used for the determination to the misregistration amount of 2 pixels (step S47). Then, the routine proceeds to step S49.

In step S49, the control section 60 reads the formed pattern 74 for the temporary detection by the photosensor 34 so as to obtain the misregistration amount of the other color with black defined as a reference. More specifically, the control section 60 reads the pattern for the correction in the main scanning direction so as to obtain the misregistration amount in the main scanning direction. Further, the control section 60 reads the pattern for the correction in the sub-scanning direction so as to obtain the misregistration amount in the sub-scanning direction. Then, the process is ended. The misregistration amount obtained here is determined in step S13 in FIG. 6.

FIG. 8 is a flowchart showing the procedure of the temporary detection different from that in FIG. 7. FIG. 7 shows the procedure when the image forming apparatus 100 has a toner remaining amount sensor that can detect the remaining amount of the toner in the toner storing chamber. FIG. 8 shows a procedure when the image forming apparatus 100 has a toner empty sensor and a color pixel counter instead of the toner remaining amount sensor. In FIG. 8, the control section 60 monitors the count value of each pixel of yellow, magenta, and cyan so as to specify the color component having the smallest count value (step S51). Since the pixel count value indicates the pixel number of the image formed after the toner storing chamber is exchanged, the pixel count value represents the total pixel number of the image formed after the toner storing chamber becomes full of toner.

When the color component having the smallest total pixel number is yellow (step S53), the pattern 74 for the temporary detection is formed by using the yellow toner and the black toner that is the reference color (step S55). The control section 60 also sets the threshold value used for the determination to the misregistration amount of 3 pixels (step S57). Then, the routine proceeds to step S69. On the other hand, the color component having the smallest total pixel number is magenta (step S59), the pattern 74 for the temporary detection is formed by using the magenta toner and the black toner that is the reference color (step S61). The control section 60 also sets the threshold value used for the determination to the misregistration amount of 2.5 pixels (step S63). Then, the routine proceeds to step S69. When the determination in step S59 is NO, i.e., when the color component having the smallest total pixel number is cyan, the pattern 74 for the temporary detection is formed by using the cyan toner and the black toner that is the reference color (step S65). The control section 60 also sets the threshold value used for the determination to the misregistration amount of 2 pixels (step S67). Then, the routine proceeds to step S69.

In step S69, the control section 60 reads the formed pattern 74 for the temporary detection by the photosensor 34 so as to obtain the misregistration amount of the other color with black defined as a reference.

When it is determined that the main detection is to be executed as a result of the temporary detection, the misregistration amount obtained in the temporary detection may be quoted in the main detection. In this case, in the main detection, only a pattern of a color component that is not formed in the temporary detection is formed, and read so as to obtain the misregistration amount. Alternatively, the pattern for the color component whose pattern is formed in the temporary detection is formed. In this case, the pattern formed in the temporary detection is omitted, and the misregistration amount obtained in the temporary detection may be quoted for the omitted pattern.

The significance that the threshold value used for the determination as to whether the main detection is performed or not is differed for every color component will be explained in detail. The factors for the color misregistration include the thermal expansion of the housing of the LSU 64, a thermal expansion of the belt drive roller 32, etc. When the misregistration amount of cyan, magenta, and yellow is obtained with black pattern defined as a reference, the color misregistration caused by the thermal expansion greatly appears in the image forming section of the image forming sections PC, PM and PY that is most apart from the black image forming section PK. Specifically, the color misregistration caused by the thermal expansion of the LSU housing in the image forming section that is most apart from the image forming section PK greatly appears. In the image forming section that is most apart from the image forming section PK, the distance that the transfer belt moves between the image forming section PK and this image forming section is long. Therefore, the color misregistration caused by the thermal expansion of the belt drive roller 32 greatly appears.

It is assumed that each of the allowed values of the misregistration between K–C, K–M, and K–Y that can be allowed as a product is, for example, 3 dots. When Y is used as a representative color for the temporary detection, Y whose image forming section is most apart from the K image forming section is under worse condition compared to C and M as described above. Therefore, the threshold value is set to 3 dots that are the same as the allowed value. Specifically, even if the misregistration of Y–K exceeds the allowed value of 3 dots, the fear of the misregistration of C–K and M–K exceeding the misregistration of Y–K is small, and it is considered that the misregistration of C–K and M–K becomes not more than the allowed value of 3 dots. Accordingly, Y can be used as the representative color, so that it becomes unnecessary to perform the temporary detection for all colors.

On the other hand, if the threshold value is set to 3 dots that are the same as the allowed value when C or M is used as the representative color for the temporary detection, there is a fear that the misregistration of Y–K becomes not less than 3 dots and deviates from the allowed value. Therefore, when the representative color is C or M, the threshold value according to the distance from K is applied. In this case, the threshold value is lower than that in case where Y is a representative color. For example, 2 dots are applied as the threshold value in the case of C, while 2.5 dots are applied as the threshold value in the case of M.

Various modifications are possible for the present invention in addition to the embodiment described above. It should be understood that such modifications also fall within the aspects and scope of the present invention. The present invention is intended to embrace all alterations made within the scope of the invention defined by the appended claims and their equivalents.

What is claimed is:

1. An image forming apparatus comprising:

a plurality of image forming sections, each image forming section being capable of forming an image of a color component among plural color components under a predetermined condition, and forming a pattern of each color component for adjusting the predetermined condition;

an output section that transfers the formed images onto a recording sheet as the images being superimposed;

a detecting section that reads the formed patterns of the respective color components so as to perform a temporary detection and a main detection of a deviation from a reference under the predetermined condition; and a correction control section that determines whether the deviation detected as a result of the temporary detection exceeds a predetermined threshold value, and when the deviation exceeds the predetermined threshold value, executes the main detection to fully detect the deviation so as to correct the predetermined condition on the basis of the detected deviation, wherein the correction control section controls one or more of the image forming sections to form one or more patterns of one or more color components for the temporary detection, the number of the color components for the temporary detection being fewer than those of the patterns to be used for the main detection, and a greater threshold value is set for a first color component than for a second color component when the image forming section of the first color component is arranged more apart from the image forming section of a reference color than the image forming section of the second color component.

2. The image forming apparatus according to claim 1, wherein the condition is a forming position of each image for superimposing the images of the respective color components with a predetermined positional relationship.

3. The image forming apparatus according to claim 1, wherein the correction control section controls each of the image forming sections to form the pattern for the temporary detection for the corresponding color component with a partial pattern of the pattern for the main detection of the corresponding color component.

4. The image forming apparatus according to claim 1, wherein each of the image forming sections forms an image by using a toner of a color corresponding to each color component, and the correction control section controls each of the image forming sections so that it forms the pattern for the temporary detection by using at least a toner having the greatest remaining amount among toners exclusively used for a color image.

5. The image forming apparatus according to claim 1, wherein each image comprises a plurality of pixels, the image forming apparatus further comprises a color pixel count unit that counts pixels of each color component, each of the image forming sections forms an image by using a toner of a color corresponding to each color component, the color pixel count unit counts the total pixel number of the image of each color component formed after a reference point at which toner of each color is charged, and the correction control section controls the image forming sections to form the pattern for the temporary detection by using at least a color component having the smallest total pixel number among color components exclusively used for the color image.

6. The image forming apparatus according to claim 1, wherein the color components comprise at least black, cyan, magenta and yellow ones.

7. The image forming apparatus according to claim 2, wherein the color components comprise at least black, cyan, magenta and yellow ones, and the detecting section defines black as the reference color, and performs the temporary detection and the main detection of the deviation of the other color components from the reference color.

8. The image forming apparatus according to claim 2, wherein each of the image forming sections is serially arranged in the order in which the images of the respective color components are superimposed over one another, the detecting section defines one color component as the reference color, and performs the temporary detection and the main detection of the deviation of the other color components from the reference color, and the threshold value is different for every color component.

9. The image forming apparatus according to claim 2, wherein the correction control section controls each of the image forming sections so that it forms the pattern for the temporary detection by using at least a color component whose image forming section is arranged apart from the image forming section of the reference color.

10. A method for correcting an image forming condition in an image forming apparatus that can form images of plural color components respectively under a predetermined condition, and can form patterns of the color components respectively for adjusting the condition, the method comprising causing a computer to execute the steps of:

forming one or more patterns of one ore more color components for a temporary detection by using one or more image forming sections;

reading the one or more patterns so as to perform the temporary detection of a deviation from a reference of the condition;

determining whether the deviation detected by the temporary detection exceeds a predetermined threshold value; and performing a main detection by forming patterns of plural color components when the deviation detected by the temporary detection exceeds the threshold value to fully detect the deviation to correct the condition on the basis of the deviation detected by the main detection, wherein the number of the color components for the temporary detection is fewer than those of patterns to be used for the main detection, and a greater threshold value is set for a first color component than for a second color component when an image forming section of the first color component is arranged more apart from an image forming section of a reference color than an image forming section of the second color component.

* * * * *